US005839138A

United States Patent [19]

Weidman et al.

[11] Patent Number: 5,839,138

[45] Date of Patent: Nov. 24, 1998

[54] CUSHIONED PILLOW WITH MEANS FOR ADJUSTING FIRMNESS

[76] Inventors: Edward Weidman, 404 4th Ave., East Northport, N.Y. 11731; Nancy Hassell, 1 Sutton Pl., Huntington, N.Y. 11743

[21] Appl. No.: 814,257

[22] Filed: Mar. 10, 1997

Related U.S. Application Data

[63] Continuation-in-part of Ser. No. 757,106, Dec. 2, 1996, abandoned.

[51] Int. Cl.[6] ..... A47G 9/02

[52] U.S. Cl. ..... 5/636; 5/640; 5/490

[58] Field of Search ..... 5/636, 640, 490, 5/935, 657

[56] References Cited

U.S. PATENT DOCUMENTS

| | | | |
|---|---|---|---|
| 1,068,355 | 7/1913 | McComb . | |
| 1,469,523 | 10/1923 | McGarvey | 5/490 |
| 1,871,003 | 8/1932 | Longletz et al. | 5/490 |
| 4,670,924 | 6/1987 | Spector | 5/640 |
| 4,754,511 | 7/1988 | Sargent | 5/435 X |
| 4,924,541 | 5/1990 | Inagaki | 5/468 |
| 4,945,591 | 8/1990 | Inagaki | 5/472 |
| 4,995,127 | 2/1991 | Inagaki | 5/461 |
| 5,363,524 | 11/1994 | Lang | 5/640 |

*Primary Examiner*—Michael F. Trettel
*Attorney, Agent, or Firm*—Baker & Botts

[57] ABSTRACT

An adjustable cushioned pillow includes a set of cover panels, preferably circular, forming a closed volume, which is packed with a filler material. A sleeve with a hollow interior is disposed in a loop, also preferably circular, on one of the cover panels. The sleeve contains one or more openings allowing access to the sleeve's hollow interior. A drawstring having two ends is threaded through the sleeve's hollow interior with each end of the string protruding from one of the sleeve's openings. The pillow is adjusted for firmness by pulling the ends of the drawstring together with one hand while holding the pillow with the other hand or by pulling the ends of the drawstring in opposite directions. When the drawstring is pulled, the sleeve constricts and reduces the surface area of the cover panel on which the sleeve is located. In turn, the reduction of surface area reduces the volume of the pillow, compressing the filler material and increasing the firmness of the pillow. Once the desired firmness of the pillow has been achieved, the ends of the drawstring may (but need not) be tied into a knot to maintain the desired level of firmness without further manual control. To reduce the firmness of the pillow, the drawstring may be loosened.

6 Claims, 3 Drawing Sheets

CUSHIONED PILLOW WITH MEANS FOR ADJUSTING FIRMNESS

SPECIFICATION

This application is a continuation-in-part of U.S. patent application Ser. No. 08/757,106, filed Dec. 2, 1996, now abandoned.

BACKGROUND OF THE INVENTION

This invention relates to a pillow for comfortably supporting parts of a person's body and, more specifically, to a pillow whose firmness can be adjusted easily depending on the preference of the person using it. Pillows, cushions, and other pads for supporting a person's head, neck, and other parts of the body are well known. In general, such pillows have a soft fabric cover and are filled with a soft filler material such as feathers, down, cotton, sponge, or polyester fibers. These pillows have the disadvantage, however, that their firmness cannot be adjusted to suit different users' preferences or to suit an individual user's varying preferences.

For example, it is well know that different individuals within the same family often have different preferences with respect to the firmness of pillows. These differences may pose a conflict with respect to the selection of shared pillows, such as throw pillows. In addition, an individual user's preference for the firmness of a pillow may change under different conditions. For example, a person may wish to have a soft pillow to lie down on for napping, but a firmer pillow on which to prop his or her neck and shoulders for reading or sunbathing. In these situations, typically, the users either must compromise or must purchase multiple pillows. At best, however, the first solution only partially satisfies each user or need, and the second solution may be costly and inconvenient.

Some prior art pillows have attempted to provide adjustable firmness through the use of snap fasteners. For example, U.S. Pat. No. 1,068,355, issued to McComb, discloses a pillow having snap fasteners arranged diagonally across one side of the pillow and mating snap fasteners arranged diagonally across the opposite side. A person adjusts the firmness of the pillow by folding one corner of the pillow into itself and engaging the snap fasteners. In addition, U.S. Pat. No. 5,363,524, issued to Lang, discloses a pillow having snap fasteners arranged in grid-like patterns on the inside surfaces of the pillow's covers. The grid-like patterns of snap fasteners are aligned to mate with each other and are capable of partitioning the pillow into regions. A person may adjust the firmness of the pillow by manipulating a filler material into or out of a region and engaging the appropriate snap fasteners. A disadvantage of these pillows is that the engagement of multiple snap fasteners may require some time, patience and manual dexterity.

U.S. Pat. No. 4,945,591, issued to Inagaki, discloses another type of adjustable pillow. The pillow has a row of therapeutic chips on its front surface and a row of anchor pads, vertically aligned with the chips, on its back surface. The chips and anchor pads are attached to the pillow through the use of a string, which is threaded in a stitch-like pattern through the front and back of the pillow and alternately passes through the chips and anchor pads. When the string is pulled taut, the string presses the chips rigidly against the front surface of the pillow, increasing the pressure applied to the body by the chips. A disadvantage of this pillow, of course, is that the firmness of the pillow cannot be adjusted.

Accordingly, there is a need for a cushioned pillow whose firmness is easily adjustable.

SUMMARY OF THE INVENTION

The present invention is directed to a cushioned pillow that is easily adjustable. The pillow comprises a set of cover panels, preferably circular, forming a closed volume, which is packed with a filler material. A sleeve with a hollow interior is disposed in a loop, also preferably circular, on one of the cover panels. The sleeve contains one or more access openings allowing access to the sleeve's hollow interior. A drawstring having two ends is threaded through the sleeve's hollow interior with each end of the string protruding from one of the sleeve's access openings.

The pillow is adjusted for firmness by pulling the ends of the drawstring together with one hand while holding the pillow with the other hand or, alternatively, by pulling the ends of the drawstring in opposite directions. When the drawstring is pulled, the sleeve constricts and reduces the surface area of the cover panel on which the sleeve is located. In turn, the reduction of surface area reduces the volume of the pillow, compressing the filler material and increasing the firmness of the pillow. Once the desired firmness of the pillow has been achieved, the ends of the drawstring may (but need not) be tied into a knot to maintain the desired level of firmness without further manual control. To reduce the firmness of the pillow, the drawstring may be loosened.

Preferably, the pillow is filled with a lightweight and washable filler material. Such filler material includes feathers, foam rubber, polyfiberfill, and expanded polystyrene pellets or beads. Of these materials, the expanded polystyrene pellets or beads is the most preferred.

These and other features, aspects, and advantages of the present invention will become better understood with regard to the following detailed description, appended claims, and accompanying drawings.

DETAILED DESCRIPTION

Figure 1:
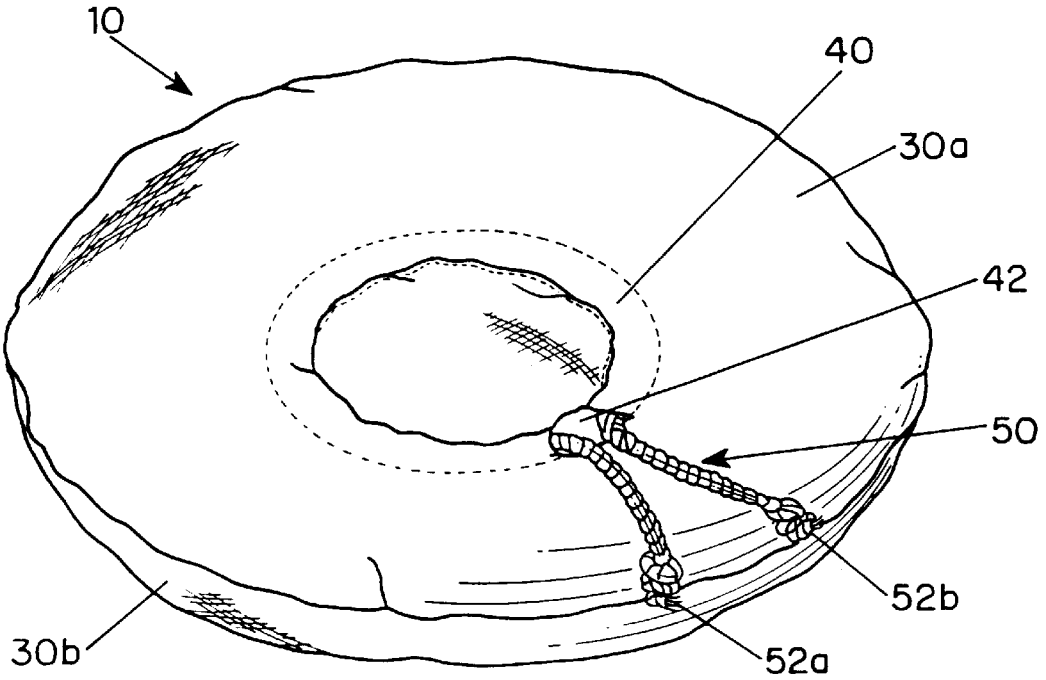
FIG. 1 is a three-dimensional perspective view of an embodiment of the present invention.
Figure 2:
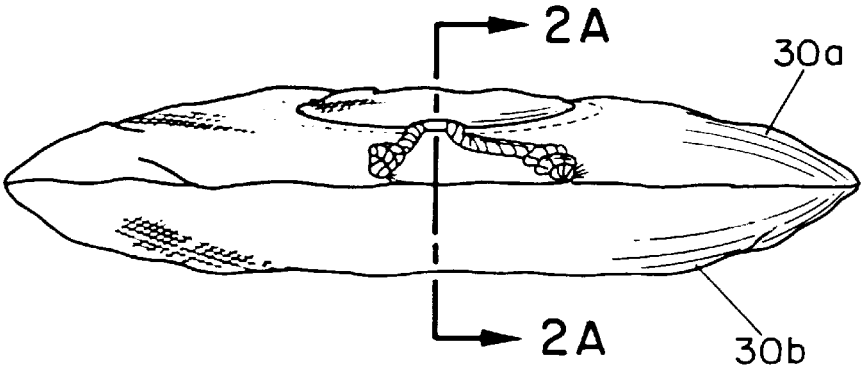
FIG. 2 is a front view of an embodiment of the present invention.
Figure 2A:
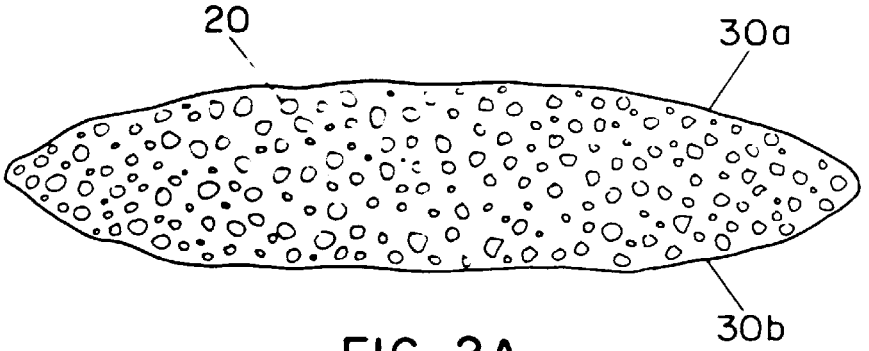
FIG. 2A is a sectional view of an embodiment of the present invention taken along line 2—2 of FIG. 2.
Figure 3:
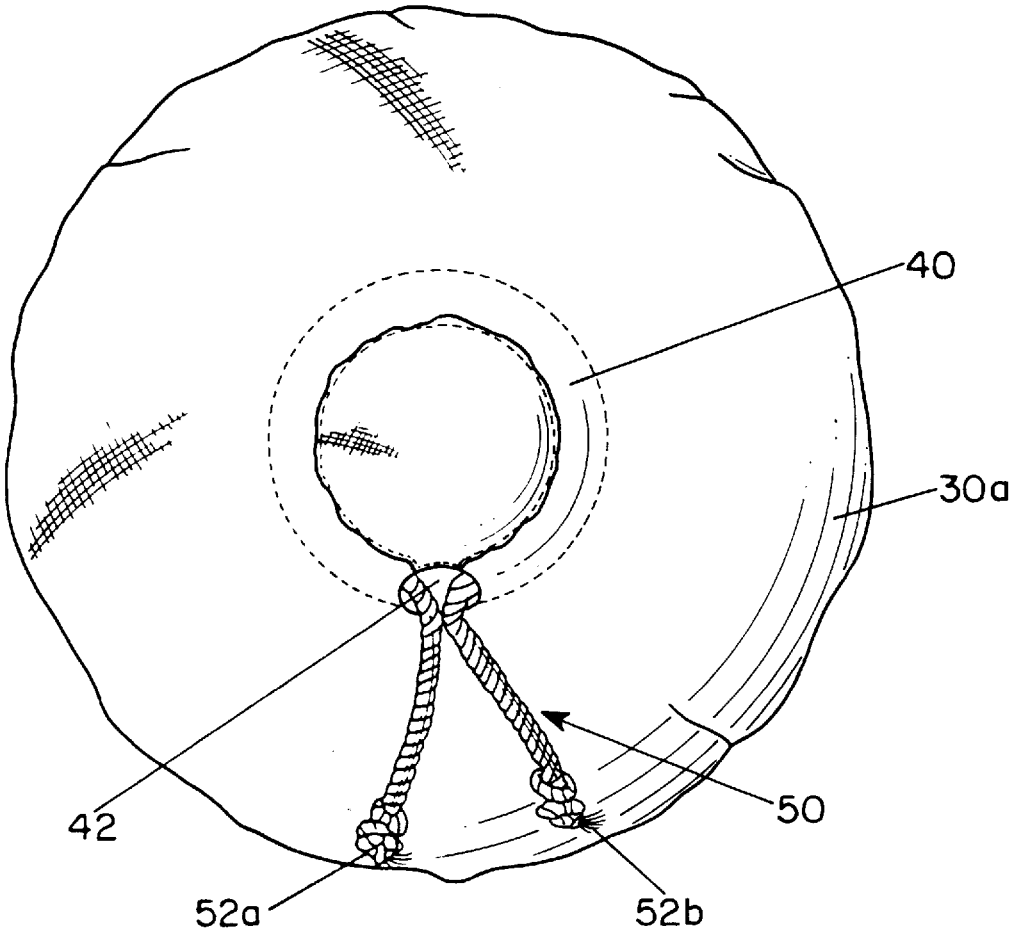
FIG. 3 is a top view of an embodiment of the present invention.
Figure 4:
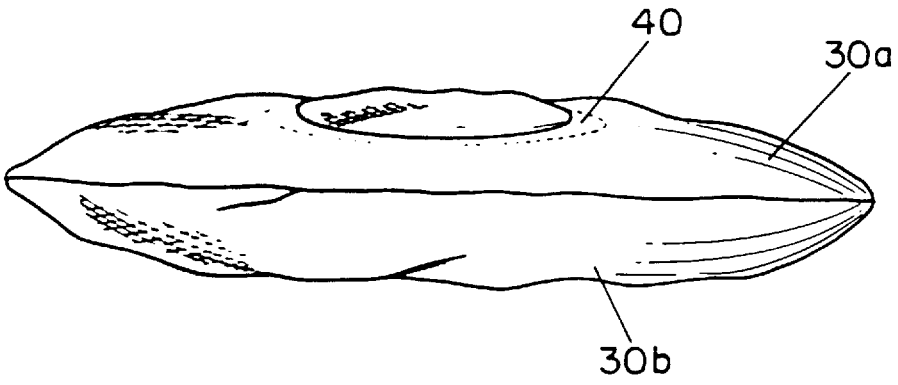
FIG. 4 is a back view of an embodiment of the present invention.
Figure 5:
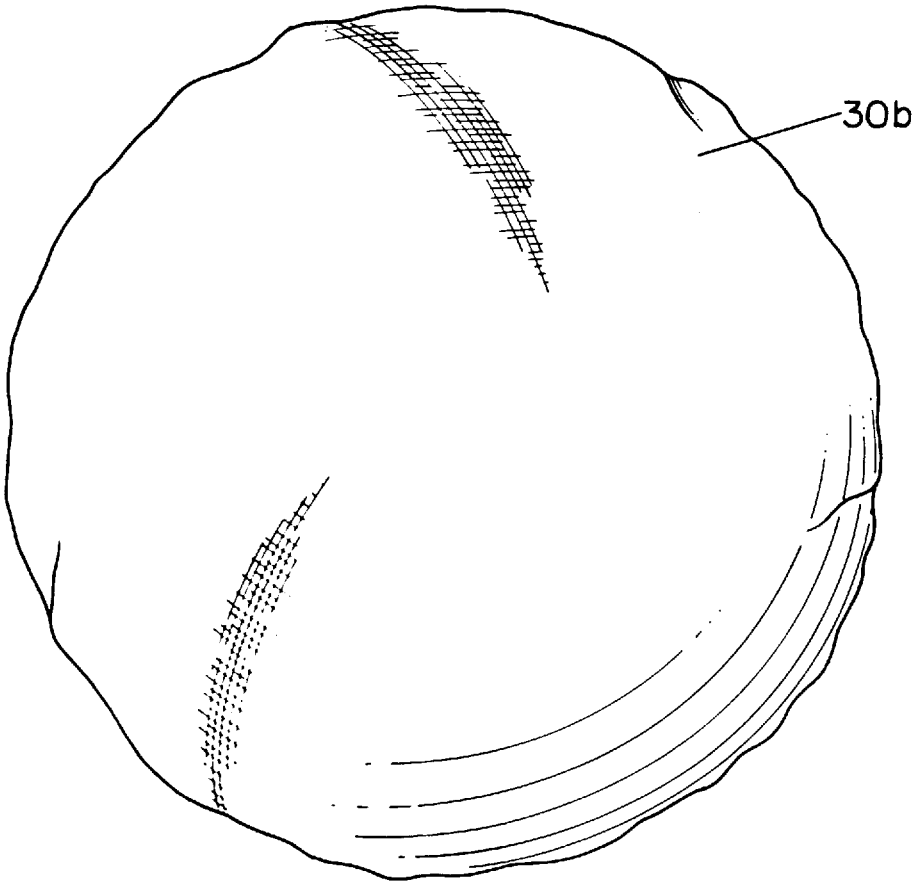
FIG. 5 is a bottom view of an embodiment of the present invention.

As shown in FIGS. 1 to 5, a preferred embodiment of an adjustable cushioned pillow 10 according to the present invention contains a filler material 20, a first cover panel 30*a*, a second cover panel 30*b*, a sleeve 40, and a drawstring 50. In the preferred embodiment shown, the first cover panel 30*a* and the second cover panel 30*b* are circular. The outer edges of the first cover panel 30*a* and the second cover panel 30*b* are fastened together, for example by stitching, to form a closed volume, which is packed with the filler material 20. The sleeve 40 is disposed on the first cover panel 30*a* in a circular loop, whose radius is about one-quarter of the radius of the first cover panel 30*a*. The sleeve 40 is hollow and has an access opening 42 allowing access to the sleeve's interior. The drawstring 50 has two ends, a first end 52*a* and a second end 52*b*. The drawstring 50 is threaded through the sleeve 40 so that each end of the drawstring, 52*a* and 52*b,* protrudes from the access opening 42.

To adjust the firmness of the pillow, the ends of the drawstring 52*a* and 52*b* may be pulled together with one hand while the pillow 10 is held with the other hand. For best leverage, the pillow 10 is held in the vicinity of the access opening 42. Alternatively, the pillow's firmness may be adjusted by pulling the ends of the drawstring in substantially opposite directions. Once the desired firmness of the pillow is achieved, the ends of the drawstring 52*a* and 52*b* may (but need not) be tied into a knot to maintain the desired level of firmness without further manual control. The knot may be untied and the string loosened to return the pillow to its original firmness.

In operation, when the ends of the drawstring 52*a* and 52*b* are pulled, the sleeve 40 constricts and reduces the surface area of the first cover panel 30*a*. In turn, the reduction of the surface area of the first cover panel 30*a* reduces the volume of the pillow. Consequently, the filler material is compressed and the firmness of the pillow is increased.

Preferably, the pillow is filled with a lightweight and washable filler material. Such filler material includes feathers, foam rubber, polyfiberfill, and expanded polystyrene pellets or beads. Of these materials, the expanded polystyrene pellets or beads is the most preferred.

The present invention has a variety of uses. For example, it can be used as a throw pillow on a sofa or love seat; as a pillow for reading or sunbathing at a beach or pool; or as a pillow for resting while traveling in cars, trains, and airplanes. With regard to the last use as a pillow for traveling, it is advantageous to make the present invention small enough to fit within a purse, briefcase, or carry-on baggage. Of course, other uses are possible and the invention is not limited to the uses just described.

Moreover, although the present invention has been described with reference to a certain preferred embodiment, other embodiments are possible, of which the following are examples. Firstly, instead of the circular cover panels of the preferred embodiment, it is possible to have cover panels of other geometric patterns, such as square or rectangular cover panels. Secondly, instead of the usual two cover panels, it is possible to have any number of cover panels. For example, a pillow having six cover panels forming a cube could be made. Thirdly, instead of a circular loop, it is possible to have loops of other shapes, such as square loops. Lastly, instead of one access opening, it is possible to have more than one access opening. For example, two separate access openings located in close proximity to each other would work just as well as one opening. Therefore, the spirit and scope of the appended claims should not be limited to the preferred embodiment contained in this description.

We claim:

1. An adjustable cushioned pillow comprising:

one or more cover panels forming a closed volume;

a filler material packed within the closed volume;

a sleeve having a hollow interior attached in a loop on at least one cover panel, the sleeve having one or more access openings allowing access to the sleeve's hollow interior; and a drawstring having two ends, the drawstring threaded through the sleeve's hollow interior with each end of the drawstring protruding from one of the access openings of the sleeve, whereby the firmness of the pillow may be adjusted by manipulating the drawstring.

2. The adjustable cushioned pillow of claim 1 in which the pillow has a first cover panel and a second cover panel.

3. The adjustable cushioned pillow of claim 2 in which the first cover panel and the second cover panel are circular.

4. The adjustable cushioned pillow of claim 3 in which the sleeve is arranged in a circular loop.

5. The adjustable cushioned pillow of claim 4 in which the radius of the circular loop is approximately one-quarter of the radius of the first cover panel.

6. The adjustable cushioned pillow of claim 1 in which the filler material is either feathers, foam rubber, polyfiberfill, or expanded polystyrene pellets or beads.

* * * * *